United States Patent [19]

Lew et al.

[11] Patent Number: 4,593,787

[45] Date of Patent: Jun. 10, 1986

[54] SKY-SLIDE SYSTEM FROM ELEVATED STRUCTURES

[76] Inventors: Hyok S. Lew, 7890 Oak St., Arvada, Colo. 80005; Michael Stranahan, P.O. Box 15, Woody Creek, Colo. 81656

[21] Appl. No.: 562,839

[22] Filed: Dec. 19, 1983

[51] Int. Cl.[4] ..... A62B 1/20

[52] U.S. Cl. ..... 182/3; 182/10; 182/191

[58] Field of Search ..... 182/3–10, 182/189, 191, 192; 188/65.1, 65.2; 242/107

[56] References Cited

U.S. PATENT DOCUMENTS

| | | | |
|---|---|---|---|
| 44,934 | 11/1864 | Chandler | 182/191 |
| 283,159 | 8/1883 | Spencer | 182/3 |
| 287,492 | 10/1883 | Woodward | 182/3 |
| 293,177 | 2/1884 | Joyce | 182/10 |
| 295,929 | 4/1884 | Macdonough | 182/10 |
| 346,406 | 7/1886 | Hutchings | 182/10 |
| 1,587,427 | 6/1926 | Schwier | 242/107 |
| 1,824,279 | 9/1931 | Koleska | 182/5 |

FOREIGN PATENT DOCUMENTS

| | | | |
|---|---|---|---|
| 5882 | of 1911 | United Kingdom | 182/3 |

*Primary Examiner*—Reinaldo P. Machado

[57] ABSTRACT

This invention relates to a rapid emergency escape system from elevated structures such as the fire-escape system from the top of a sky scraper to the ground level, which rapid descending system includes a vertical wire rope securely anchored to an over-hanging structure secured to the desired level of the elevated structure wherein said wire rope branches to at least two wire ropes with the lower ends of each reaching down to the ground level. The lower end of each of the branching wire ropes includes a connecting means and is connected to the free end of each of the horizontal wire ropes wherein each of the horizontal wire ropes is reeled up into two reels immovably secured and widely separated from each other. The reels include braking means for releasing the horizontal wire ropes while maintaining a certain level of the controlled tension on the wire ropes and means for rewinding the wire ropes back into the reels. The person escaping from the elevated structure to the ground level wears a harness secured around one's torso and limbs which includes a sturdy tether with a strong clasp attached to the free end of the tether. Upon hooking said clasp onto the vertical wire rope with the branching wire ropes stretched tight into the shape of a pyramid as the horizontal wire ropes are reeled up by the reels, the person wearing the harness jumps down, descends, and lands on the ground safely as the tension on the branching wire ropes and the controlled release of the horizontal wire ropes slows down the descending velocity to a safe point as the person approaches the ground level.

6 Claims, 3 Drawing Figures

SKY-SLIDE SYSTEM FROM ELEVATED STRUCTURES

BACKGROUND OF THE INVENTION

The fire hazard in high rise apartments, hotels and office buildings is amply demonstrated by the recurring tragedies involving the lose of lives and properties in many densely populated cities with many high rise buildings. Often the occupants of the high rise buildings are cut off from the escape route to the ground level by the fire and smoke erupting in the lower elvels and consequently, they are forced to escape to the upper levels and the top of the building. At the present time the only way to rescue the people from the top of the burning sky scraper is by helicopter, which cannot be executed to pluck out people from the other levels of the high rise building which are beyond the reach of the fire truck ladder. In general, the fire rescue operations using helicopters or fire truck ladders are slow, inefficient and hazardous tasks that require a great deal of improvement. The truth is that there is no simple reliable and inexpensive means for escaping from a burning high rise building available at the present time, which escape means is permanently installed as a part of the building structures and is always there to be used whenever a necessity arises.

The primary object of the present invention is to provide an emergency escape system from an elevated structure wherein the major portion of the system is permanently installed as a part of the emergency measure incorporated into the building structure.

Another object of the present invention is to provide a simple and inexpensive emergency escape system from an elevated structure, the operation of which is simple, reliable and reusable.

A further object of the present invention is to provide an emergency escape system from the elevated structure that is operative with the minimum amount of the equipment on the ground level hooked up to the escape system.

Still another object of the present invention is to provide an emergency escape system from the elevated structure that can be tucked away and stored in such a way that the ordinary use of the elevated structure is not hindered at all by the escape system.

Still a further object of the present invention is to provide an escape system from the elevated structures that can be used by the average people including the children, women and men of average mental and physical capability.

These and other objects of the present invention will become clear as the description thereof proceeds.

BRIEF DESCRIPTION OF FIGURES

The present invention and its objects may be described with a greater clarity and specificity by referring to the following Figures.

SPECIFICATION

Figure 1:
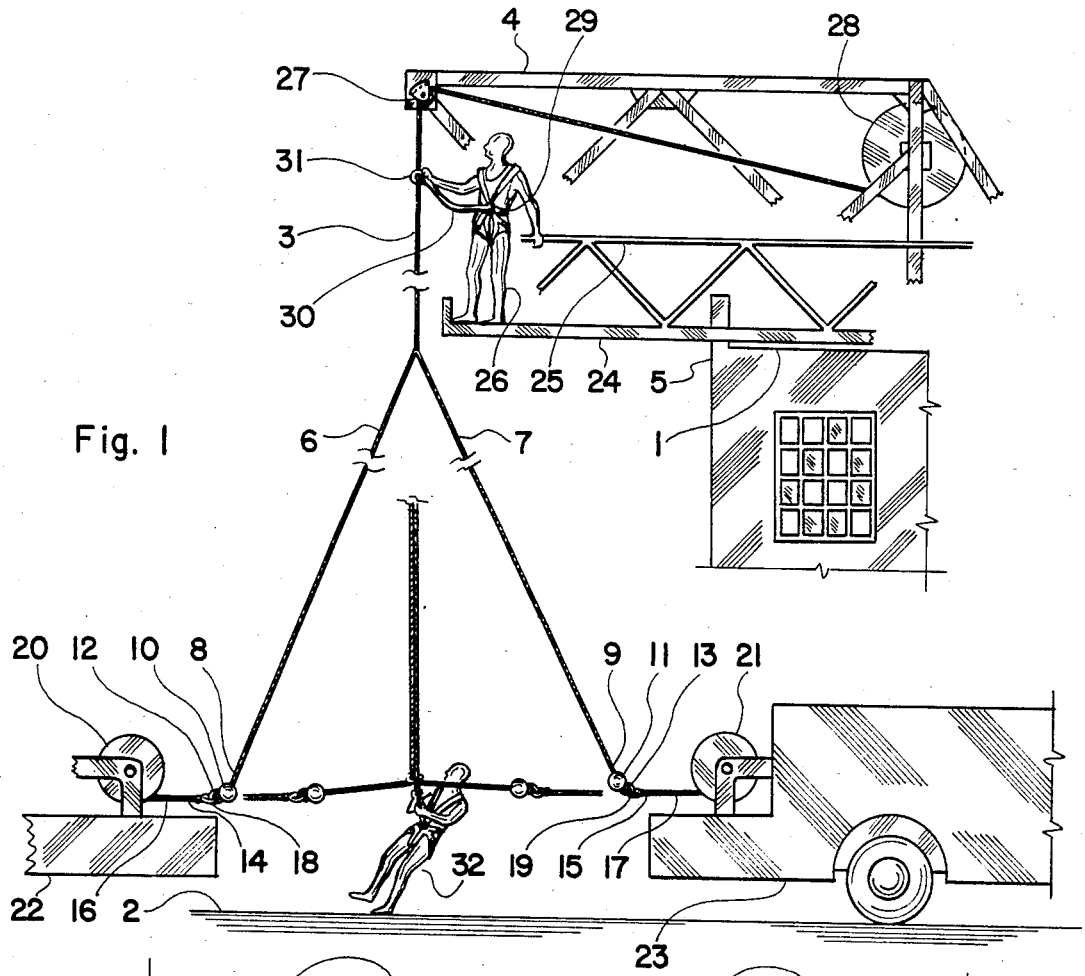
FIG. 1 illustrates a perspective view of the sky-slide system showing its constructions and the operating principles.

In FIG. 1 there is shown a perspective sky-slide system for escaping from an upper level of the elevated structure to a lower level in an emergency, which system is constructed in accordance with the principles of the present invention. This sky-slide escape system from an upper level 1 to a lower level 2 comprises a vertical wire rope or cord 3 depending from an overhanging structure 4 secured to the upper level structure 5 such as the top of a high rise building or upper level floors, which vertical wire rope or cord 3 is branched to at least two branching wire ropes or branching cords 6 and 7 having the lower ends 8 and 9 reaching down the lower level 2. Each of the lower ends 8 and 9 of the branching wire ropes or branching cords includes the weights 10 and 11 and connection means 12 and 13, respectively, each of which connection means 12 and 13 connects the lower ends of the branching wire ropes or cords to each free end 14 and 15 of the horizontal wire ropes or cords 16 and 17 with connection means 18 and 19 wherein the number of the horizontal wire ropes or cords are matched to that of the branching wire ropes or cords. Each of the horizontal wire ropes or cords 16 and 17 are reeled up into each of the reels 20 and 21, which reels are equipped with means for releasing the horizontal wire ropes or cords 16 and 17 while maintaining a controlled amount of the tension on the horizontal wire ropes or cords and, consequently, on the branching wire ropes or cords which means may be simple friction type brakes or other electromagnetic apparatus releasing the horizontal wire ropes or cords with a constant or preprogrammed tension. The reels 20 and 21 further includes means for reeling up the horizontal wire ropes or cords 16 and 17, which means may be power-operated reels with clutches. The reels 20 and 21 are immovably stationed on the lower level 2 and are separated from one another by a sizable distance. For an example, the reels 20 and 21 may be powered reels with clutches and brakes mounted on a pair of fire trucks 22 and 23 parked on the lower level 2 at two separated locations of approximately equal distance away from the vertical line including the vertical wire rope or cord 3. The over-hanging structure 4 includes a walkway 24 with the guard rails 25 which leads the escaping person 26 to the vertical wire rope or cord 3, and an idler sheave 27 and a take-up reel 28, which combination is for reeling up the vertical wire rope or cord 3 and the branching wire ropes or cords 6 and 7 into the take-up reel 28 until the weights 10 and 11 attached to the lower ends are brought all the way up to the idler sheave 27 after disconnecting the branching wire ropes or cords 6 and 7 from the horizontal wire ropes or cords 16 and 17. The take-up reel 28 should include a locking means that keeps the take-up reel 28 at the fully reeled up state and, thus, keeps the sky-slide system tucked away from the ordinary use of the upper level 2. The take-up reel 28 must have a powered drive to reel up the long wire ropes depending from it.

When an emergency arises requiring the evacuation of the people from the upper level 1 to the lower level 2 by means of the sky-slide system, a person at the upper level 1 removes the locking means on the take-up reel 28 and the reel automatically unreels and lowers the sky-slide wire ropes or cords as they are pulled down by the weights 10 and 9 attached to their lower ends. The fire trucks 22 and 23 responding to the emergency are parked at two locations on the lower level 2 separated at a predetermined distance and an equal distance away from the vertical line including the vertical wire rope or cord 3. The fire fighting crews connect the lower ends of the branching wire ropes to the free ends of the horizontal wire/ropes and reels up the horizontal wire ropes 16 and 17 until the branching wire ropes 6 and 7 are stretched to the shape of a pyramid, at which point the take-up reel drive clutches for the reels 20 and 21 are disengaged and the braking system on the reels 20 and 21 is automatically activated. The sky-slide system is ready for use. The person 26 escaping from the upper level 1 to the lower level 2 puts on a harness securing the torso and the limbs, which are stored in the upper level 1 in suitable quantities. The harness 29 includes a sturdy tether 30 with a strong clasp 31 attached to its free end. The escaping person 26 wearing the harness 29 walks out to the end of the walkway 24 and hooks on the clasp 31 onto the vertical wire rope 3 and dives. The controlled release of the horizontal wire ropes 16 and 17 from the braked reels 20 and 21 slows down the descending velocity of the escaping person 26 to a safe landing as he or she approaches the lower level. The person 32 illustrates the person 26 who is about to land on the lower level 2 and the wire ropes of the sky-slide system at said moment. Once this person 32 unclasps, the crews reel up the horizontal wire ropes back into reels 20 and 21 until the branching wire ropes are stretched to the shape of a pyramid and, then, disconnects the reel drive clutches and activates the reel braking system. Now, the sky-slide system is ready for the next person on the upper level 1 to dive down.

It can be easily shown that the acceleration and deceleration of the person decsending by the sky-slide system is approximately given by the equation $$a = -\left(\frac{2T}{m} - g\right) + \frac{2T}{m}\sin\theta$$

T is the tension on the horizontal wire ropes maintained by the braking action on the reels installed on the fire truck; m is the mass of the person using the sky-slide system; g is the gravitational acceleration of the earth and $\theta$ is the angle between the branching wire ropes and the horizontal plane. In this formula, the effect of the friction between the clasp and the wire rope as well as the weight of the wire rope is not accounted for. It is not difficult to recognize that, when the tension on the horizontal wire rope is maintained at a value equal to the three times of the weight of the person using the sky-slide, the descending movement starts to decelerate when $\theta$ becomes equal to 56 degree and the maximum rate of deceleration is equal to 5 g at the time of landing on the lower level. By considering the energy exchange between the work done on two reels installed on the fire trucks and the potential energy of the descending person, one can easily conclude that two reels that maintain a tension on each of two horizontal wire ropes equal to three times the descending person's weight can safely slow down a person sliding down on the sky-slide system from a hight equal to six times the length of the each of the horizontal wire ropes released by the pulling action caused by the descending person on the sky-slide system. For example, a sky-slide system including a pair of reels releasing and taking-up two 100 ft. lengths of the horizontal wire ropes while maintaining 600 pounds of tension, respectively, is capable of lowering a person weighing 200 pounds from a height of 600 ft. This estimation clearly shows the feasibility of the sky-slide system for many practical applications.

Figure 2:
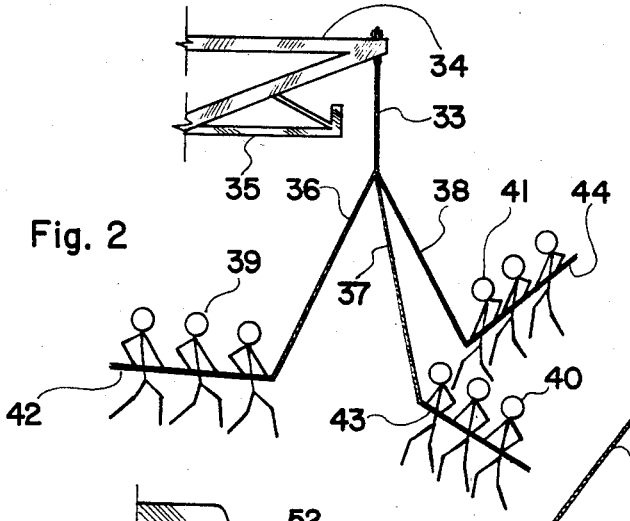
FIG. 2 illustrates a perspective view of another sky-slide system arranged in accordance with the principles of the present invention.

In FIG. 2 there is shown another embodiment for the sky-slide rescue system constructed in accordance with the principles of the present invention. The vertical wire rope or cord 33 depending from the over-hanging structure 34 with a walkway 35 is branched to three branching wire ropes or cords 36, 37 and 38. The tension on those branching wire ropes and the controlled release thereof are provided by the plurality of the people 39, 40 and 41 pulling the lower extremities 42, 43 and 44 of the branching wire ropes 36, 37 and 38 who are at the same time moving forward to the point directly below the vertical wire rope 33. When the sky-slide rescue system is not in use, the wire ropes are pulled up, coiled, and stored adjacent to the anchoring point of the vertical wire rope 33 in the over-hanging structure 34. This type of arrangement is desirable for moderately high buildings of ten stories height or less.

Figure 3:
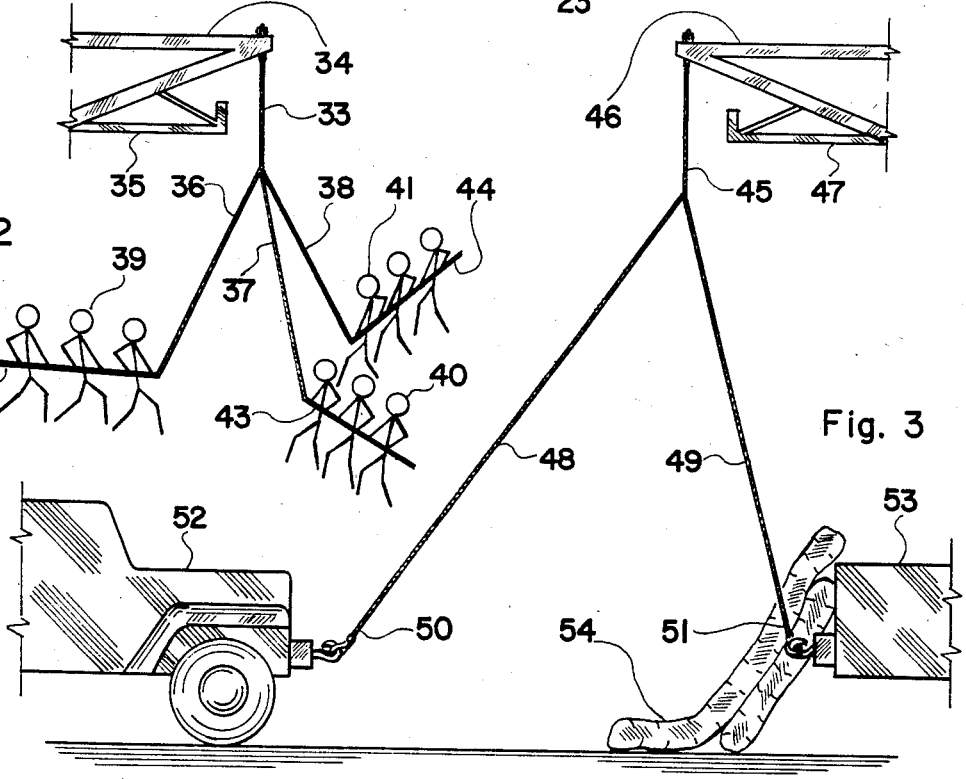
FIG. 3 illustrates perspective view of a further sky-slide system.

In FIG. 3 there is shown a further embodiment for a sky-slide rescue system wherein the vertical wire rope or cord 45 depending from the over-hanging structure 46 with a walkway 47 includes two branching wire ropes or cords 48 and 49. The lower end of the branching wire rope 49 is nonreleasably anchored to a stationary object such as a parked fire truck 53. The lower end 50 of the branching wire rope 48 is secured to an object providing the tension on the branching wire rope 48 and a controlled release of its lower end, which object may be a motorized ground vehicle 52 moving back and forth at a predetermined speed during the rescue operation. The cushions 54 are disposed next to the stationary object 53 anchoring the lower end 51 of the branching wire rope 49 which protects descending persons from impaction onto the stationary object 53.

While the principles of the invention have now been made clear by the illustrative embodiments, there will be immediately obvious to the skilled in the art many modifications of the arrangements, elements, proportion, structure and materials particularly adapted to the specific working environment and operating conditions in the practice of the invention without departing from those principles of the present invention.

We claim:

1. A rapid descending system from an elevated structure to a lower level comprising in combination:

(a) a cord depending from an elevated structure, said cord branching into at least two branching cords;

(b) means for releasably securing the lower extremities of said branching cords respectively disposed at separate positions, said means including power-driven reels equipped with braking means for a powered take-up and braked release of said lower extremities of said branching cords wherein said power-driven reels take up said branching cords providing initial tension on and angle between said branching cords prior to a descending and said braking means provide continuous release of said branching cords at controlled speeds during a descending; and (c) a harness including a clasp means secured to said harness securable to a person, said clasp means being an annular structure with opening-closing means, whereby, a person wearing said harness clasps said clasp means on said cord, jumps off from the elevated structure and lands safely on the lower level, as the tensions on said branching cords maintained by said braking means included in said power-driven reels during the release of said branching cords at controlled speed slows down the descending speed of the person.

2. The combination as set forth in claim 1 wherein the lower extremities of said branching cords are removably secured to said means for releasably securing the lower extremities of said branching cords.

3. The combination as set forth in claim 2 wherein said rapid descending system includes means disposed at the elevated structure for reeling up said cord and branching cords; whereby, said cord and branching cords can be stowed away when said rapid descending system is not in use.

4. A rapid descending system from an elevated structure to a lower level comprising in combination:

(a) a cord depending from an elevated structure, said cord branching into at least two branching cords;

(b) means for anchoring lower extremity of one of said branching cords to a stationary location at a lower level;

(c) means for releasably securing the lower extremities of said branching cords excluding said one branching cord respectively disposed at separate positions, said means including power-driven reels equipped with braking means for powered take-up and braked release of said lower extremities of said branching cords wherein said power-driven reels take up said branching cords providing initial tension on and angle between said branching cords prior to a descending and said braking means provide continuous release of said branching cords at controlled speeds during a descending; and (d) a harness including a clasp means secured to said harness securable to a person, said clasp means being an annular structure with opening-closing means, whereby, a person wearing said harness clasps said clasp means on said cord, jumps off from the elevated structure and lands safely on the lower level, as the tension on said branching cords maintained by said braking means included in said power-driven reels during the release of said branching cords at controlled speed slows down the descending speed of the person.

5. The combination as set forth in claim 4 wherein the lower extremity of said one branching cord is removably anchored to the lower level and the lower extremities of the other branching cords are removably secured to said means for releasably securing the lower extremities of said branching cords.

6. The combination as set forth in claim 5 wherein said rapid descending system includes means disposed at the elevated structure for reeling up said cord and branching cords; whereby, said cord and branching cords can be stowed away when said descending system is not in use.

* * * * *